United States Patent [19]

Mathiolon et al.

[11] 4,237,683

[45] Dec. 9, 1980

[54] DEVICE FOR DELIVERING YARNS

[75] Inventors: Henri Mathiolon, Lyons; Jean Hourmagne, Caluire, both of France

[73] Assignee: Verdol S.A., Caluire, France

[21] Appl. No.: 2,147

[22] Filed: Jan. 9, 1979

[30] Foreign Application Priority Data

Oct. 25, 1978 [FR] France ..... 78 30996

[51] Int. Cl.[3] ..... D01H 7/86; D01H 1/10; D01H 13/10

[52] U.S. Cl. ..... 57/58.86; 57/58.83; 57/352

[58] Field of Search ..... 57/58.49, 58.83, 58.86, 57/352, 58.7, 58.72

[56] References Cited

U.S. PATENT DOCUMENTS

| | | | |
|---|---|---|---|
| 2,022,424 | 11/1935 | Langwieler | 57/58.49 |
| 2,076,762 | 4/1937 | Bochmann | 57/58.49 X |
| 3,293,839 | 12/1966 | Yanobu | 57/58.86 |
| 3,338,042 | 8/1967 | Vibber | 57/58.86 X |
| 3,742,693 | 7/1973 | Grieve et al. | 57/58.86 |

FOREIGN PATENT DOCUMENTS

| | | | |
|---|---|---|---|
| 1184681 | 12/1964 | Fed. Rep. of Germany | 57/58.86 |
| 404168 | 1/1934 | United Kingdom | 57/58.86 |

*Primary Examiner*—Donald Watkins
*Attorney, Agent, or Firm*—Dowell & Dowell

[57] ABSTRACT

A device for delivering multiple yarns, each taken from a bobbin, comprises means for braking each yarn, other means for acting on less stretched yarns so that they advance at the same speed as the most stretched yarn, and finally a guide ensuring the displacement of these yarns parallel to one another. It may further comprise a conventional brake with elastic cheeks for each yarn, an idle drum with a non-skid peripheral coating with which the yarns cooperate before passing over a separator system.

7 Claims, 6 Drawing Figures

Fig. 1
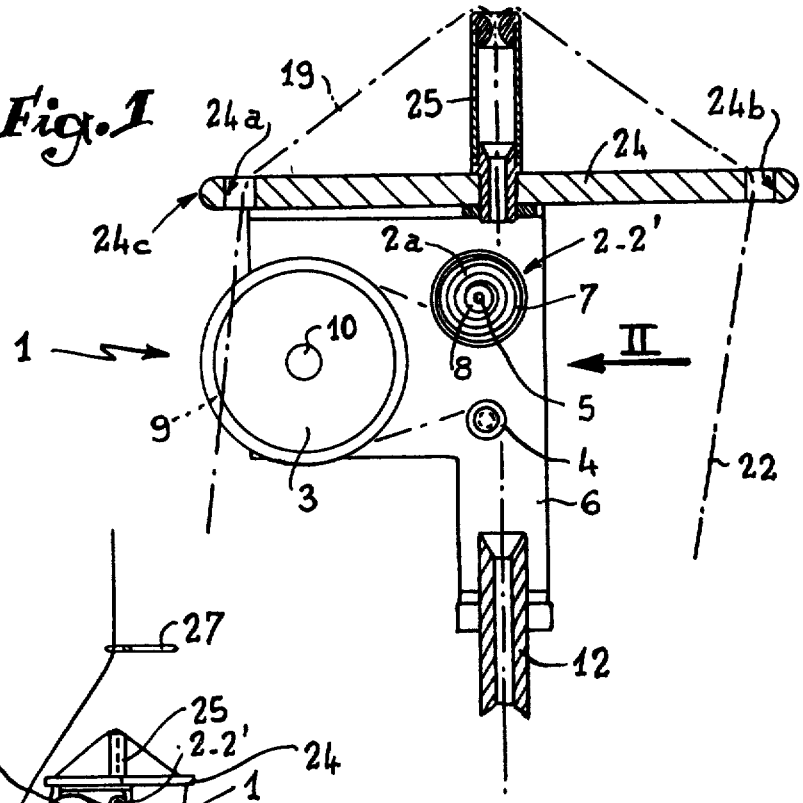
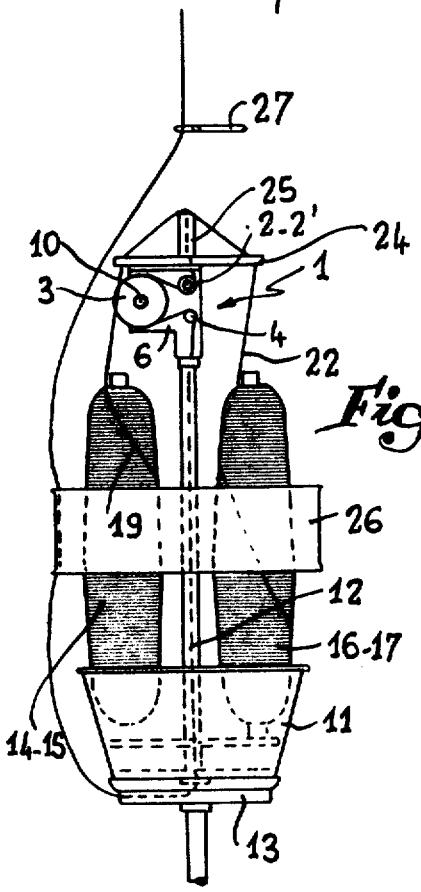
Fig. 3
Fig. 2
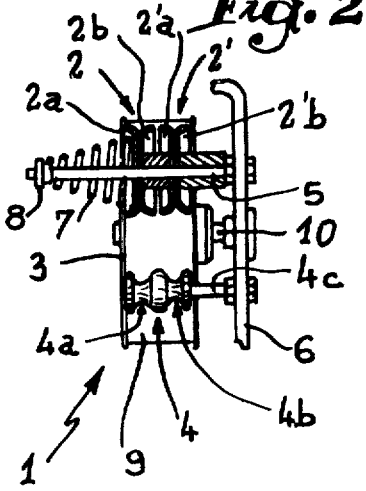

DEVICE FOR DELIVERING YARNS

The present invention relates to a regulating device for delivering at least two yarns each taken from a different bobbin, and to a mechanism provided with such a device.

When it is desired to produce a multi-strand yarn whose strands are twisted with respect to one another, one generally starts by unwinding as many yarns as strands with a view to winding them on a bobbin by means of a suitable machine, then the multi-stand yarn is twisted by means of a twisting machine such as for example a double twist spindle.

It is readily appreciated that the above embodiment is expensive as it comprises two distinct operations, each effected by a different machine.

The improvements forming the subject matter of the present invention envisage remedying these drawbacks by providing a device for regulating the advance of at least two yarns which may be associated for example with a double twist spindle or other machine with a view to obtaining a twisted yarn.

According to the invention, a number of bobbins corresponding to the number of strands of the desired yarn are placed in the conventional can of a double twist spindle. A plate is placed above the bobbins, through which each yarn passes, and repasses at its centre, with a view to cooperating with the above-mentioned regulating device.

The device in question comprises means for braking each yarn, other means for acting on the less stretched yarn so that it advances at the same speed as the other, more stretched yarn and finally a guide ensuring the displacement of these yarns parallel to one another.

The invention will be more readily understood on reading the following description with reference to the accompanying drawings, in which:

FIG. 1 illustrates a regulating device according to the invention.

FIG. 2 is a view thereof in the direction of arrow II (FIG. 1).

FIG. 3 shows a double twist spindle provided with a regulating device according to the invention.

Figure 4:
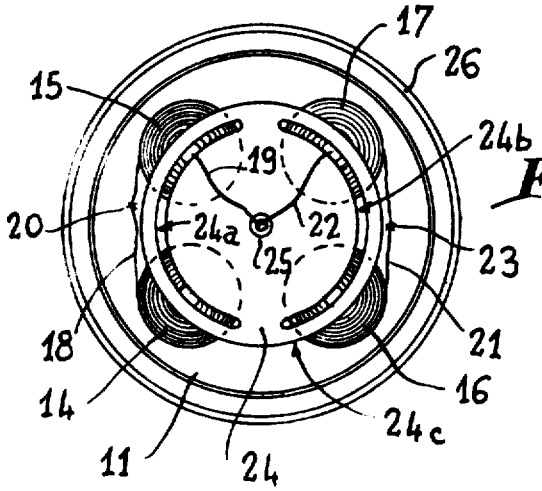
FIG. 4 is a plan view thereof on a larger scale.

Referring now to the drawings, FIG. 1 shows a device for regulating the advance of at least two yarns which has been given the general reference 1. This device comprises three main elements: a yarn brake 2, a drum 3 and a separator 4.

If it is desired that two yarns advance at the same speed, two brakes 2, 2' are mounted side by side on the same pin 5 fast with a plate 6. The brakes 2, 2' are constituted in known manner by two dishes **2*a*–2*b*, 2'*a*–2'*b* of which the peripheries are divergent and which are applied against each other by means of a spring 7 whose tension is adjustable by means of a nut 8. The drum 3 is made in the form of a pulley with cheeks between which is disposed a coating 9 having a high coefficient of friction and of which the width is greater than the distance separating the brakes 2, 2'. It is noted that the drum 3 is mounted to rotate freely in overhang about a shaft 10 of which one of the ends is assembled on the plate 6. For particular applications, the drum could be braked with respect to the shaft 10. The separator 4 is constituted by a cylinder provided with two grooves 4*a*, 4*b* located in the transverse plane of symmetry of each brake 2, 2'. The separator 4 comprises a shank 4*c* connected to the plate 6**.

FIG. 3 illustrates the use of a device according to FIGS. 1 and 2 on a double twist spindle. In known manner, this spindle comprises a fixed can 11 with respect to the centre of which a hollow shaft 12 fast with a plate 13 rotates. Inside the can 11 are installed two pairs of bobbins 14–15, 16–17 (FIG. 4). These bobbins are provided to be elongated and, in the winding technique, are called cops. The yarns 18–19 issuing from bobbins 14–15 are knotted at 20 whilst yarns 21–22 from bobbins 16–17 are similarly connected by a knot 23. The yarn 19 passes through an arcuate slot **24*a* made in the vicinity of the periphery of a plate 24 disposed above the hollow shaft 12. Symmetrically, this plate comprises a second slot 24*b* through which passes the yarn 22 coming from bobbin 17. The two yarns pass downwardly through in a vertical shaft 25 fast with the centre of the plate 24 so that they cooperate respectively with the yarn brakes 2, 2', i.e. they are each engaged between the dishes thereof. The two yarns then surround the major part of the periphery of the drum 3 (for example 250°) and then they pass in around each of the grooves of the separator 4. It will be noted that the winding arc may be adjustable either by displacing the shaft 10 with respect to the plate 6**, or by modifying the location of the brakes or of the separator.

The regulating device functions as follows: If the yarns tend to advance at unequal speeds, i.e. if one of them is subjected to a higher tension than the other, the yarn of greater tension drives the drum in rotation, this increasing the displacement of the less stretched yarn so that the two yarns are delivered in equal lengths. It is observed that the tensions on the yarns are produced by the brakes 2, 2' which make the drum 3 act as a winch.

In the application illustrated in FIG. 3, the yarns pass through in the bore of the shaft 12 and leave through a radial opening in the plate 13 so that the rotation thereof achieves the twisting of the two yarns. The bobbins are surrounded in known manner with a sleeve 26 which limits the diameter of the balloon. The twisted yarn passes through a guide ring 27 and then it winds on a bobbin (not shown) which exerts a pull thereon.

It is observed that the use of two pairs of bobbins whose yarns are connected allows the passage of the yarn from one bobbin or cop to the other, automatically, without manual intervention or stoppage of the spindle.

The slots provided in the plate 24 allow the yarn to pass without jerks from one cop to the other, this yarn sliding naturally along said slots. In addition, the outer edge **24*c* of the plate limits the inward displacement of any twisted yarn of the balloon, so that it does not penetrate into the zone in which the regulating device 1 is located, nor does it intersect the yarns which pass through the slots 24*a*, 24*b***.

Furthermore, it is possible to fix, either on the plate 24, or on plate 6, devices for detecting the presence of each end, for detecting the tension of each yarn or for stopping a yarn in case of breakage. These devices may act either on thread-cutters themselves located on the plate 24 inside the balloon, or outside, to trigger off a warning signal or stoppage of one member or another. The transmission of data through the balloon is effected by a known means, for example by a photoelectric cell.

Figure 5:
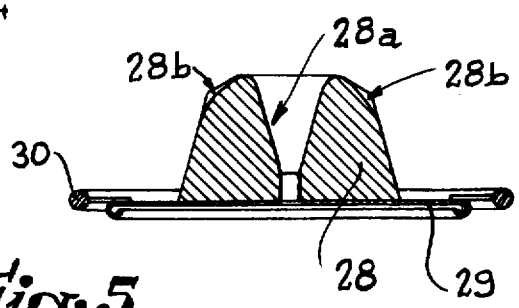
FIG. 5 shows a variant embodiment of the plate associated with the device according to the invention.
Figure 6:
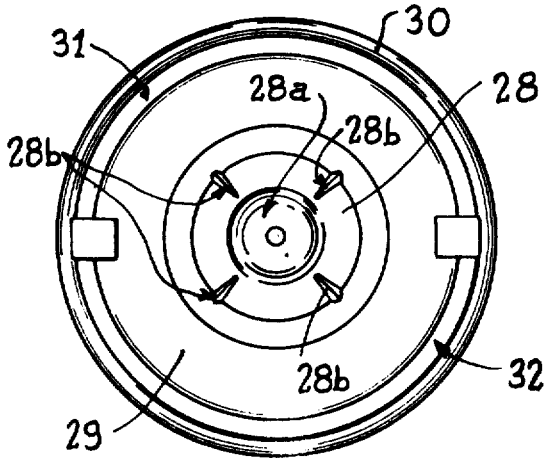
FIG. 6 is a plan view thereof.

As a variant, the shaft 25 may be constituted by a conical frustum 28 (FIG. 5) with an upwardly open truncated bore 28*a*. The provision of notches 28*b*, oriented at 90° with respect to one another which enable the yarn to be guided when it leaves one or the other of the bobbins is observed. In other words, each notch is disposed above the centre of one of the bobbins of the double twist spindle. The conical frustum 28 is fixed at the centre of a disc 29 which replaces the plate 24, this disc being surrounded by a ring 30 adapted to define slots 31–32 similar to slots 24*a*, 24*b*.

It is obvious that if it is desired to make a twisted yarn with three or four strands, as many pairs of bobbins are provided, so that, for each strand, two supply bobbins are provided.

A device for regulating the advance of a plurality of yarns is thus produced, which makes it possible, when applied to a twisting machine, to obtain a twisted yarn of excellent quality since its different strands are delivered at the same speed.

It is obvious that the above description has been given by way of non-limiting example and that equivalent elements may replace those described, without departing from the scope of the invention. In particular, the axes of the bobbins or cops may be concentric although the parallel arrangement of the axes is advantageous due to the reduced dimensions.

What is claimed is:

1. A yarn regulating device for feeding multiple yarns pulled by a machine from different bobbins and delivering the yarns at equal speeds, comprising multiple brake means comprising paired discs resiliently urged together and operative respectively to receive said yarns from the cops and independently tension the yarns;

separator means for said yarns operative to maintain the separation of the yarns provided by said multiple brake means and operative to guide the yarns toward said machine; and a rotatable drum having an annular peripheral surface with a high coefficient of friction coating thereon, the drum being located between the brake means and the separator means and offset therefrom such that said peripheral surface aligns with both the brake means and the separator means, the yarns while traveling from the brake means to the separator means passing around said peripheral surface in side-by-side relationship whereby all of the yarns advance from the drum to the separator means at equal speeds despite independent brake tensioning.

2. The device as claimed in claim 1, wherein said machine comprises a twisting machine having a hollow rotating spindle and having a can supporting bobbins, and the machine having a plate above said bobbins with a central yarn guide hole above said spindle, the yarn regulating device being located between the plate and the hollow spindle with the brake means aligned with the central hole and with the separator means guiding the yarns into the spindle.

3. The device as claimed in claim 2, wherein each bobbin comprises paired cops connected in series, and the plate has as many openings as there are paired cops, the yarns feeding through said openings into the central guide hole.

4. The device as claimed in claim 3, wherein said openings are in the form of arcuate openings through the plate and extending around the plate coextensively with each pair of cops.

5. The device as claimed in claim 3, wherein the central yarn guide hole comprises a length of pipe having a bore leading toward the brake means and conducting all of the yarns theretoward.

6. The device as claimed in claim 5, wherein said pipe has an upper end receiving said yarn and comprising an upwardly and outwardly opening conical portion terminating in an upper periphery having yarn guiding notches extending toward said openings in the plate.

7. The device as claimed in claim 1, wherein the drum is sufficiently offset from the brake means and the separator means that the yarns each pass more than half way around the peripheral surface of the drum.

* * * * *